United States Patent [19]

Gregoli

[11] Patent Number: 4,501,445

[45] Date of Patent: Feb. 26, 1985

[54] METHOD OF IN-SITU HYDROGENATION OF CARBONACEOUS MATERIAL

[75] Inventor: Armand A. Gregoli, Tulsa, Okla.

[73] Assignee: Cities Service Company, Tulsa, Okla.

[21] Appl. No.: 518,987

[22] Filed: Aug. 1, 1983

[51] Int. Cl.[3] ..... E21B 43/24; E21B 43/26; E21B 43/40; E21C 41/10

[52] U.S. Cl. ..... 299/2; 166/267; 166/303; 166/308

[58] Field of Search ..... 166/247, 259, 261, 266, 166/267, 272, 303, 308; 299/2, 4, 5

[56] References Cited

U.S. PATENT DOCUMENTS

| | | | |
|---|---|---|---|
| 2,595,979 | 5/1952 | Pevere et al. | 166/303 |
| 3,228,467 | 1/1966 | Schlinger et al. | 166/266 |
| 3,515,213 | 6/1970 | Prats | 166/247 X |
| 3,528,501 | 9/1970 | Parker | 166/247 X |
| 3,598,182 | 8/1971 | Justheim | 166/267 X |
| 3,617,471 | 11/1971 | Schlinger et al. | 166/266 X |
| 3,948,320 | 4/1976 | Terry | 166/303 X |
| 3,973,628 | 8/1976 | Colgate | 166/303 X |
| 3,990,513 | 11/1976 | Perch | 166/303 X |
| 4,284,139 | 8/1981 | Sweany | 166/267 |

*Primary Examiner*—George A. Suchfield

*Attorney, Agent, or Firm*—George L. Rushton; William N. Patrick

[57] ABSTRACT

In-situ hydrogenation of an underground coal formation is carried out by fracturing the formation and sealing it, to provide an in-situ reactor site. Then a liquid solvent stream and a gaseous hydrogen stream are introduced into the fractured formation, allowing reaction and conversion of the coal to lighter, hydrogenated components.

41 Claims, 1 Drawing Figure

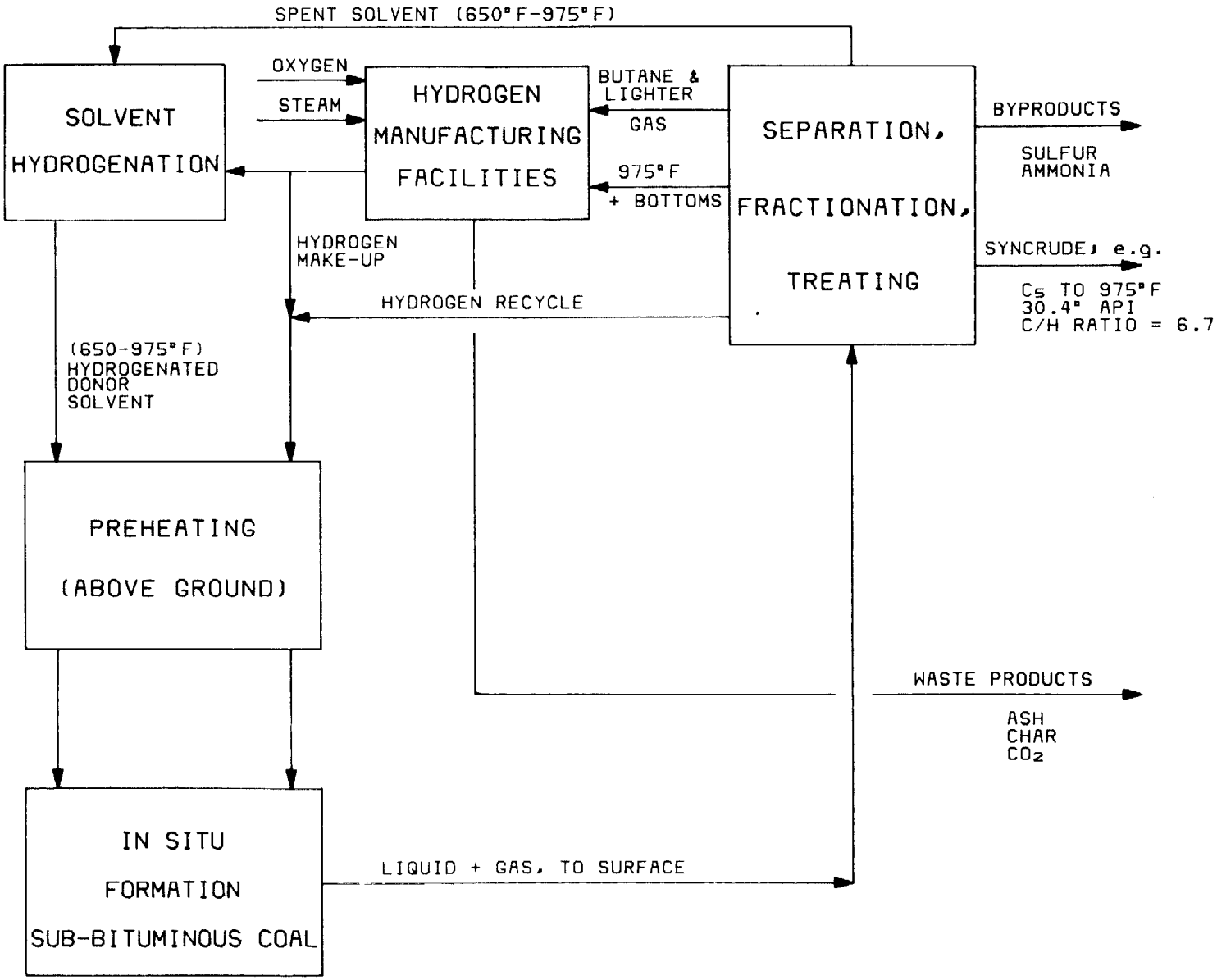
BLOCK FLOW DIAGRAM
IN-SITU HYDROGENATION OF CARBONACEOUS MATERIAL

METHOD OF IN-SITU HYDROGENATION OF CARBONACEOUS MATERIAL

BACKGROUND OF THE INVENTION

This invention concerns the recovery and upgrading of carbonaceous material by in-situ hydrogenation. In one embodiment, the invention concerns the in-situ hydrogenation of an underground coal deposit, thus converting the coal into gaseous and liquid products that can be removed easily from the underground location and further processed above ground.

Under present technology, the economics for recovery and upgrading of gaseous and liquid hydrocarbons from underground deposits of lignite, coal, oil shale, tar sands, and heavy crudes are unattractive. Broadly, the current technology employed for producing saleable products from underground deposits of the above-mentioned carbonaceous materials involves at leat two of the following operations: (1) mining, (2) crushing and/or grinding, (3) washing or extraction, followed by flotation and phase separation, (4) retorting, and (5) upgrading or refining. Further, the current technology for recovery of heavy crudes is not commercially viable. While the examples set forth in the solution will be illustrated for coal or lignite, operations for other carbonaceous deposits such as tar sands, heavy crudes, and oil shale are applicable.

The prior art teaches some of the aspects of the present invention. For example, U.S. Pat. Nos. 3,084,919 (Slater); 3,208,514 (Dew and Martin); and 3,327,782 (Hujsak) teach methods of recovering hydrocarbons by the use of hydrogen. Typically, these processes involve the use of in-situ combustion in a formation, to heat the formation and to reduce the viscosity of the hydrocarbon values in the unburned portions, followed by the introduction of a hydrogen stream, for hydrogenation of these hydrocarbon values. The hydrotreated products are then recovered and processed.

U.S. Pat. No. 3,598,182 (Justheim) introduces hot hydrogen into an underground formation, to heat the formation, to promote cracks and fissures in the formation, to reduce the viscosity of any available hydrocarbon values, and to hydrocrack at least a portion of these values. Products are then recovered and processed.

A majority of the above processes involve combustion of at least a portion of the formation. And Justheim uses an extensive temperature regulating system.

SUMMARY OF THE INVENTION

I believe I have overcome the disadvantages and drawbacks of the prior art by my process, which consists of the steps broadly discussed below.

Where the underground deposit concerns coal or oil shale or similar materials, a shaft or bore hole is drilled into the desired underground carbonaceous deposit. Then the deposit surrounding the lower end of the bore hole is fractured, thus forming an underground space suitable as a pressure reactor. A preheated solvent stream and a preheated gaseous stream containing hydrogen are then introduced into the fractured formation, where they contact the carbonaceous material and convert at least a portion of the material into hydrocarbonaceous materials having flow characteristics superior to the materials in the original carbonaceous deposit. These converted or upgraded materials are then removed from the deposit for further processing.

For heavy crudes and bitumen the formation need not be fractured, but the other steps are followed.

When compared with recovery techniques involving combustion, the present process eliminates the coking step, thus offering higher expected conversions and yields.

When the present process is applied to tar sands deposits, the hydrogen and solvent are able to penetrate the tar sand matrix. Also, the solids typically present in the crude bitumen from the tar sands have some catalytic hydrogenation activity.

The present process can be used in conjunction with conventional steam recovery or hot inert gas methods. Also, the process can be used where electrical pre-heating methods are applicable.

BRIEF DESCRIPTION OF THE DRAWINGS

The FIGURE shows a simplified block flow diagram of one embodiment of the process of the invention.

DESCRIPTION OF THE PREFERRED EMBODIMENTS

This invention relates to in-situ hydrogenation of underground carbonaceous deposits by converting the inplace deposits to lighter liquid and gaseous products, thus facilitating recovery.

The hydrogenation of carbonaceous material is exothermic and hence provides the mechanism for conversion, with attendant lowering of viscosity, pour point and surface tension. The heat of reaction is approximately 40 Btu per standard cubic foot of hydrogen chemically consumed. This will vary depending on the carbonaceous material, i.e., coal or heavy oil, and the reaction severity.

As mentioned above, the carbonaceous materials considered for such treatment are those exemplified by lignite, coal, oil shale, tar sands, and heavy crudes, such as Orinoco crude. The process can also be applied to depleted underground crude oil deposits, i.e., enhanced oil recovery. In any carbonaceous material, some materials will react more favorably to the process than will others. Materials having higher H/C ratios will be easier to process and recover than will those with lower ratios. For example, coals, having a lower H/C ratio, are usually more difficult to convert and recover than the heavy crudes or bitumen, which have higher ratios. Typically, the preferred carbonaceous materials are those that are not economically recoverable by conventional technology, such as some of the heavier crudes (Orinoco in Venezuela aromatic heavy crudes), heavy Santa Maria, California crudes, deep tar sands in Canada, and oil shales. Thin seams of coal which are deep and not mineable by conventional methods can also be considered as candidates for this process.

The depth and size of the underground carbonaceous formation are considered when the economics of the process are calculated. If conventional mining technology is too expensive, it is expected that the process of this invention would be a viable choice.

The dimensions of the bore hole and the methods of forming such are considered under conventional technology and need not be considered here. Typically, the bore hole is drilled to or near the lower portion or extremity of the desired formation.

Similarly, by known technology, fracturing of the formation immediately surrounding the bottom or lower portion of the bore hole is carried out. Fracturing of the material can result in a particle size distribution varying from a fraction of an inch up to several feet. Since contact surface between the carbonaceous material and the introduced reagents is important, it is desirable to have the particle size distribution as narrow as possible, such as that varying from a fraction of an inch up to fragments of four to six inches. This particle size refers to the fragments obtained by fracturing coal or shale. Certain tar sands, by their very nature, have small particles of sand imbedded in a bitumen matrix. And the heavy crudes are somewhat tar-like in character, and may not be amenable to the fracturing process as applied to coal.

Since the preferred embodiments contemplate carbonaceous materials such as coal or shale, the parameters of the process will be mainly concerned with such materials.

After fracturing the surrounding formation, a portion of the fractured material, or rubble, can be removed, by means known in the art. This removal of a portion of the fractured material results in a void space, wherein processing materials can be introduced. Additional fracturing can be carried out at various times to expose more of the formation to the processing materials. Removal of the fractured material may not be necessary with certain materials.

It is desirable that the bore hole connecting the underground deposit with the surface be formed so as to seal off the underground formation, since a gaseous stream is introduced into the underground formation as a portion of the processing material. The process of in situ hydrogenation of the carbonaceous materials can be carried out at pressures varying from about 200 psi to about 2000 psi. A maximum pressure is determined by the overburden and its integrity. These factors are known in the art, and the present invention can be adjusted for those factors.

The reaction or processing materials introduced into the carbonaceous formation are exemplified as (a) a liquid solvent and (b) a gaseous stream containing hydrogen. Since one objective of this invention is to recover and upgrade hydrocarbon streams from the carbonaceous material, the solvent stream used is preferably a hydrocarbon cut obtained from the processing of such carbonaceous materials. For example, a hydrocarbon cut having a boiling range from about 300° F. to about 1200° F. can be used. It is realized that different formations will yield process streams that will provide major cuts having different boiling ranges. It is also possible to use lower boiling cuts, such as propane or hexane, as a "light end" portion of the solvent to promote solution of some of the constituents of the carbonaceous material, thus promoting further reactions on the exposed portions of the material. In like manner, other solvents, such as methylene chloride, trichloroethane, or dimethyl sulfoxide, can be used. Since these latter solvents introduce non-hydrocarbon atoms, processing of the resultant solution streams can offer problems. Therefore, the preferred solvent stream is hydrocarbon in nature. It is realized that some compounds containing hetero oxygen and hetero nitrogen atoms can be obtained from coal and thus might enter into the solvent stream, but these are a minor fraction of the total stream. As noted in the flow sheet of the FIGURE, spent solvent, resulting from the aboveground separation and treating step, is treated with hydrogen to become a hydrogen donor and is then recycled underground as a processing material. The FIGURE shows the spent solvent having a boiling range of 650° F. to 975° F., and such a stream can be used as a solvent stream.

In terms of shale, typically there is little material that boils above 1100° F. Therefore, the fraction which can be recycled can be in the range of 700°-1100° F. With heavy crudes or tar sands, this recycle stream can have a boiling range of 300°-1000° F.

A desirable characteristic of the solvent stream is that it be a hydrogen donor/acceptor. Such a characteristic improves the operating capabilities of the process underground, since the crude materials extracted from the carbonaceous materials are converted by hydrocracking to lighter materials. Simultaneously, the hydrogen-rich environment hydrotreats the carbonaceous materials, such as by desulfurization or denitrogenation, and this hydrotreating improves the characteristics of the treated material. These hydrocracked and hydrotreated materials are typically miscible with the solvent stream and thus are transported to the surface, where the whole stream can be processed, with the desirable constituents removed as a sidestream. At least a portion of the residue can be returned as a solvent stream after hydrogenation.

Hydrogen donors/acceptors are compounds, such as aromatic hydrocarbons, that can donate and accept one or more hydrogen atoms in various environments. Such donors/acceptors are recognized and known in chemical and engineering areas, e.g., coal liquefaction and hydroprocessing. Naphthalene and its hydrogenated analog, tetralin, are exemplary of pairs of compounds that are used as hydrogen donors/acceptors. Some other pairs are anthracene/1,2,3,4-tetrahydroanthracene and naphthacene/1,2,3,4-tetrahydro naphthacene. For the purposes of this invention, the desirable physical properties of such a pair include a suitable boiling range (of the hydrogenated and dehydrogenated compounds), solvent activity, separability from material contacted in the underground formation and carried to the separation apparatus on the surface, and desirable heat transfer characteristics.

The solvent has many functions, in that it can be utilized as (a) a vehicle for heat transfer, (b) a solvent for at least a portion of the carbonaceous material, and (c) a carrier for hydrogen and any soluble catalyst used. Also, a portion of the product stream furnishes a fractionation cut that can be used as a solvent.

The hydrogen-containing stream used in this process comprises a gaseous stream having at least about 50% (vol.) hydrogen. This is based on economics. Production of a hydrogen-containing stream utilizes a 975° F.+ fraction product material as feed to the hydrogen plant, utilizing conventional proven technology, i.e., partial oxidation. This 975° F.+ fraction is thus consumed and does not appear as an end product.

Depending on the purity of the hydrogen stream, or the percentage of hydrogen in a mixed gaseous stream, the pressure of hydrogen may approach the total pressure in the reaction system. Since the desired reaction in the underground carbonaceous formation is the hydrocracking of the higher molecular weight hydrocarbon portions of the material, the partial pressure of hydrogen in the total gaseous environment underground is important when applied to the rate of hydrogenation or the residence time of the gas in contact with the carbonaceous material.

Since the reaction medium comprises a liquid solvent stream and a hydrogen-containing gaseous stream, the ratio of the liquid portion to the gaseous portion of the total reactant streams can vary widely. Since the rate of a hydrogenation reaction varies proportionally to the temperature, hydrogen partial pressure and residence time, it is desirable that the liquid stream and the gaseous stream both be preheated aboveground. The initial time period of the process of this invention typically will be concerned with contacting the underground deposit with the solvent stream, to afford a reaction medium wherein hydrogenation can occur. Thus, the initial ratio of liquid to gas in the total reaction stream will be higher than the ratio found later in the process, when a greater surface area underground offers greater contact surface for the hydrocracking reaction. At this time, the liquid/gas ratio is lower than the initial value. Since the hydrocracking reaction is typically exothermic, the underground temperature can be controlled by the temperature of the incoming liquid and gaseous streams. The liquid portion of the reaction streams affords a greater mass and hence heat transfer and thus a higher coefficient of heat transfer between the reaction medium and the carbonaceous material.

Since the initial period of the total processing time is concerned with dissolving some of the carbonaceous material in order to enlarge the reaction volume, the weight or volume of converted products that will be initially recovered and moved to the surface, for processing and recycling, will be small. Thus, a high proportion of the total reaction stream going down the bore hole to the deposit comprises a recycle stream, at a suitable temperature to raise the temperature of the reaction medium underground.

As mentioned before, the operating parameters for the total process vary, depending on the time period involved. The pressure underground can vary from about 200 to about 2000 psi, with the partial pressure of hydrogen varying in response to the purity of the hydrogen stream introduced. The reaction temperature underground can vary from about 500° F. to about 900° F., with a range of 200° F. to 900° F. for some materials. The initial temperature underground may be lower than the desired range, but this temperature can be increased by the temperature of the incoming reaction streams. Another significant factor concerns the exothermic heat available from the hydrocracking and hydrotreating reactions.

All of these factors, such as formation temperature, recycle stream temperature, total pressure, partial pressure of hydrogen, and the type of carbonaceous material to be hydrogenated, enter into the conversion of the carbonaceous material to more desirable products. Typically, a higher hydrogen partial pressure offers a more complete reaction or conversion, and a higher temperature improves conversion. Conversion means the conversion of the carbonaceous material to desired lighter products.

When the carbonaceous material involves heavy crudes and bitumen, the desired reaction temperature is that temperature necessary to mobilize the liquid by itself or in conjunction with other fluids. The desired temperature is the lowest temperature consistent with project economics and technical feasibility and could be below 500° F., such as 200° F.

A hydrogenation catalyst can be used in this process. Typically, the process steps are concerned with contacting the carbonaceous material, dissolving it, at least preliminary hydrocracking, and removal of the mobilized stream to the surface, where additional hydrocracking under more conventional hydrogenation conditions can be effected. Some conventional hydrogenation catalysts that can be used include cobalt-molybdenum on alumina base and nickel-molybdenum on alumina base.

Many coals, tar sands, oil shales, and heavy crudes contain metallic compounds or clays that can act as hydrogenation catalysts. Analysis of the material removed from underground by the recycle stream offers guidance for the use of added catalysts.

The residence time for an in-situ hydrogenation underground is difficult to determine, since it depends on the contact surface available between carbonaceous material and reaction streams, temperature, pressure, available hydrogen, and the flow rate of the incoming and exiting reaction streams. The residence time, after achieving reaction conditions, can vary from a few hours to several weeks, depending on the combination of the aforementioned variables. As previously mentioned, the overall economics of the process dictate the preferred ranges for these variables, with the product streams aboveground being the important factors. The aboveground separation and further treatment of the reaction streams from the reaction zone are accomplished by known processes. This downstream treatment involves conventional technology and need not be considered here. The recycle gas and liquid streams can be varied in accordance with the underground formation, the desired product streams, reaction conditions underground, and overall economics.

EXAMPLE

Referring to the FIGURE and using an established subbituminous deposit, previously fractured and with the concentric pipes in place for the addition and withdrawal of materials and sealed to reduce gas leakage, 1533 BPD of a 650°-975° F. cut (containing a hydrogenated donor solvent, a highly aromatic material that is easily hydrogenated) are introduced in the coal deposit, along with about $13\times10^6$ SCFD of a hydrogen-containing gas (approximately 90 vol. % $H_2$)

The coal has a moisture-free analysis of

| | % |
|---|---|
| H | 4.5 |
| C | 62.5 |
| N | 0.8 |
| O | 15.1 |
| S | 0.5 |
| ash | 16.6 |

with a heating value of 8300 BTU/lb. and C/H ratio of 13.9. The reaction conditions in the coal formation are 1600 psi and 800° F. The residence time of the introduced mixture is approximately 4 days.

The effluent from the in-situ hydrogenation formation, after typical separating, fractionating, and treating procedures, comprises 1000 BPD liquid (30.4° API, a product range of $C_5$-975° F., C/H ratio=6.7), sulfur (1.58 TPD), ammonia (2.36 TPD), butane and lighter gas stream ($1.66\times10^9$ BTU/day, used for fuel), recycled hydrogen ($5\times10^6$ SCFD), and 155 BPD of 975° F.+ bottoms, used as feed for known processes of hydrogen manufacture (as by steam reforming or partial oxidation).

The original 1533 BPD of 650°-975° F. cut are maintained as a recycling inventory. Of the 1000 BPD of $C_5$-975° F. product, about 160 BPD are a 650°-975° F. cut. Broadly, the waste products are ash, char, and $CO_2$.

The synthetic liquid crude product of 1000 BPD has the analysis of

| Cut | C/H | Wt. % S | Wt. % N | °API |
|---|---|---|---|---|
| $C_5$-400° F. | 5.6 | 0.07 | 0.15 | 47 |
| 400-650° | 7.0 | 0.01 | 0.3 | 22 |
| 650-975° | 9.9 | 0.2 | 0.7 | 8 |

The in-situ hydrogenation is confirmed by the difference between the C/H ratio of the subbituminous coal (13.9) and the C/H ratio of the major product (6.7).

Also, it is noted that the sulfur content of the raw coal (0.5 wt. %) is decreased to about 0.11 wt. % S in the products. Similarly, the nitrogen content decreases from about 0.8 wt. % to about 0.27 wt. %. The oxygen compounds are essentially eliminated.

I claim:

1. A process for the recovery of carbonaceous materials from an underground formation by in-situ hydrogenation, comprising:

(a) drilling a bore hole into an underground formation containing carbonaceous material and placing concentric pipes in said bore hole for the addition and withdrawal of materials, (b) fracturing a portion of the formation containing carbonaceous material surrounding the bore hole, (c) sealing off said underground formation around said pipes to form the equivalent of a pressure reactor in the formation below the seal, (d) introducing a preheated liquid solvent stream and a preheated gaseous stream comprising hydrogen through the bore hole into said fractured formation, (e) contacting the carbonaceous material in said fractured formation with said preheated solvent and said preheated hydrogen to produce a product mixture comprising at least a partially hydrogenated carbonaceous material, and (f) removing said product mixture from said fractured formation.

2. The process of claim 1 wherein said product mixture comprises, in addition, dissolved carbonaceous material.

3. The process of claim 1 wherein the carbonaceous material is selected from the group consisting of coal, oil shale, tar sands, and heavy crudes.

4. The process of claim 1 wherein the pressure in the in-situ formation is maintained at from about 200 psi to about 2000 psi.

5. The process of claim 1 wherein the temperature in the in-situ formation is maintained at from about 500° F. to about 900° F.

6. The process of claim 1 wherein at least a portion of the liquid stream is a hydrocarbon-containing liquid having a boiling range of from about 300° F. to about 1200° F.

7. The process of claim 1 wherein at least a portion of the liquid stream is a hydrocarbonaceous liquid having the property of donating and accepting hydrogen, with a boiling range of from about 650° to about 975° F.

8. The process of claim 1 wherein the gaseous stream is at least about 50 volume percent hydrogen.

9. The process of claim 1 comprising, in addition, separating, fractionating, and hydrocracking said product mixture to provide a product comprising a 975° F. product fraction, and using said product fraction as feed for a hydrogen producing plant.

10. The process of claim 1 wherein the preheated liquid stream and the preheated gaseous stream are mixed prior to contacting the underground carbonaceous material.

11. The process of claim 1 comprising, in addition, removing a portion of said fractured formation prior to contacting said carbonaceous material in-situ in said fractured formation with said preheated liquid solvent and said preheated gas comprising hydrogen.

12. A process for the recovery of carbonaceous materials from an underground formation by in-situ hydrogenation, comprising:

(a) drilling a bore hole into an underground formation containing carbonaceous material selected from the group consisting of coal, oil shale, tar sands, and heavy crudes, and placing concentric pipes in said bore hole for the addition and withdrawal of materials, (b) fracturing a portion of the formation containing carbonaceous materials surrounding the bore hole, (c) sealing off said underground formation around said pipes to form the equivalent of a pressure reactor in the formation below the seal, (d) maintaining said underground formation at a pressure of from about 200 psi to about 2000 psi and at a temperature within a range of from about 500° F. to about 900° F., (e) introducing (1) a preheated liquid solvent stream, wherein at least a portion of the liquid stream is a hydrocarbonaceous liquid having the property of donating and accepting hydrogen and having a boiling range of from about 650° to about 975° F. and wherein at least a portion of the liquid stream is a hydrocarbon-containing liquid having a boiling range of from about 300° to about 1200° F., and (2) a preheated gaseous stream comprising at least about 50 volume percent hydrogen, into the deposit through the bore hole, (f) contacting the carbonaceous material in said fractured formation with said preheated solvent and said preheated hydrogen to produce a product mixture comprising at least a partially hydrogenated carbonaceous material and dissolved carbonaceous material, and (g) removing said product mixture from said fractured formation.

13. The process of claim 12, comprising, in addition, separating, fractionating, and hydrocracking said product mixture to provide a product comprising a 975° F.+ product fraction, and using said product fraction as feed for a hydrogen producing plant.

14. A process for the recovery of carbonaceous materials from an underground formation comprising:

(a) drilling a bore hole into an underground formation containing carbonaceous material and placing concentric pipes in said bore hole for the addition and withdrawal of materials, (b) sealing off said underground formation around said pipes to form the equivalent of a pressure reactor in the formation below the seal, (c) introducing a preheated liquid solvent stream and a preheated gaseous stream comprising hydrogen into the deposit through the bore hole, (d) contacting the carbonaceous material in the formation with said preheated liquid solvent stream and said preheated gaseous stream to produce a product mixture comprising at least a partially hydrogenated carbonaceous material, and (e) removing said product mixture from said formation.

15. The process of claim 14 wherein said product mixture comprises, in addition, dissolved carbonaceous material.

16. The process of claim 14 wherein the carbonaceous material is selected from the group consisting of tar sands and heavy crudes.

17. The process of claim 14 wherein the pressure in the in-situ formation is maintained at from about 200 psi to about 2000 psi.

18. The process of claim 14 wherein the temperature in the in-situ formation is maintained within a range of from about 500° F. to about 900° F.

19. The process of claim 14 wherein at least a portion of a liquid stream is a hydrocarbon-containing liquid having a boiling range of from about 300° F. to about 1200° F.

20. The process of claim 14 wherein at least a portion of the liquid stream is a hydrocarbonaceous liquid having the property of donating and accepting hydrogen, and having a boiling range of from about 650° to about 975° F.

21. The process of claim 14 wherein the gaseous stream is at least about 50 volume percent hydrogen.

22. The process for the recovery of carbonaceous materials selected from the group consisting of tar sands and heavy crudes, from an underground formation, comprising:

(a) drilling a bore hole into an underground formation containing carbonaceous material and placing concentric pipes in said bore hole for the addition and withdrawal of materials, (b) sealing off said underground formation around said pipes to form the equivalent of a pressure reactor in the formation below the seal, (c) introducing (1) a preheated liquid solvent stream, wherein at least a portion of said stream is a hydrocarbon-containing liquid having a boiling range of from about 300° F. to about 1200° F., and further wherein at least a portion of said stream is a hydrocarbonaceous liquid having the property of donating and accepting hydrogen and having a boiling range of from about 650° F. to about 975° F., and (2) a preheated gaseous stream comprising at least about 50 volume percent hydrogen, into the deposit through the bore hole, and wherein the equivalent reactor has a pressure maintained at from about 200 to about 2000 psi and further has a temperature maintained within the range of from about 500° F. to about 900° F., (d) contacting the carbonaceous material in the formation with said preheated liquid solvent stream and said preheated gaseous stream to produce a product mixture comprising at least a partially hydrogenated carbonaceous material and dissolved carbonaceous material, and (e) removing said product mixture from said formation.

23. The process of claim 22, comprising in addition separating, fractionating and hydrocracking said mixture to provide, among other products, a product comprising a 975° F.+ product fraction, and using said product fraction as a feed for a hydrogen producing plant.

24. A process for the recovery of carbonaceous materials from an underground formation comprising:

(a) contacting carbonaceous material in-situ in an underground formation with preheated liquid solvent and a preheated gas comprising hydrogen to produce a product mixture comprising at least a partially hydrogenated carbonaceous material and dissolved carbonaceous material, and (b) removing said product mixture from said formation.

25. The process of claim 24 wherein the carbonaceous material is selected from the group consisting of tar sands and heavy crudes.

26. The process of claim 24 wherein the pressure in said underground formation is maintained at from about 200 psi to about 2000 psi.

27. The process of claim 24 wherein the temperature in said underground formation is maintained at from about 500° F. to about 900° F.

28. The process of claim 24 wherein at least a portion of the liquid solvent is a hydrocarbon-containing liquid having a boiling range of from about 300° F. to about 1200° F.

29. The process of claim 24 wherein at least a portion of the liquid solvent is a hydrocarbonaceous liquid having the property of donating and accepting hydrogen, and having a boiling range of about 650°–975° F.

30. The process of claim 24 wherein at least about 50 volume percent of said preheated gas comprises hydrogen.

31. A process for the recovery of carbonaceous materials from an underground formation comprising:

(a) contacting carbonaceous material selected from the group consisting of tar sands and heavy crudes in-situ in an underground formation with (1) a preheated liquid solvent, wherein at least a portion of said liquid is a hydrocarbon-containing liquid having a boiling range of from about 300° F. to about 1200° F. and further wherein at least a portion of said liquid is a hydrocarbonaceous liquid having the property of donating and accepting hydrogen, and having a boiling range of from about 650° F. to about 975° F., and (2) a preheated gas comprising at least about 50 volume percent hydrogen, and wherein the temperature in said underground formation is maintained in the range of from about 500° F. to about 900° F. and wherein the pressure is maintained at from about 200 psi to about 2000 psi, to produce a product mixture comprising at least partially hydrogenated carbonaceous material and dissolved carbonaceous material, and (b) removing said product mixture from the formation.

32. A process for the recovery of carbonaceous materials from an underground formation, comprising:

(a) fracturing a portion of an underground formation, comprising carbonaceous material, (b) contacting the carbonaceous material in-situ in said fractured formation with preheated liquid solvent and a preheated gas comprising hydrogen to produce a product mixture of at least a partially hydrogenated carbonaceous material and dissolved material, and (c) removing said product mixture from said formation.

33. The process of claim 32 comprising, in addition, removing a portion of said fractured formation prior to contacting said carbonaceous material in-situ in said fractured formation with said preheated liquid solvent and said preheated gas comprising hydrogen.

34. The process of claim 32 wherein the carbonaceous material is selected from the group consisting of coal, oil sale, tar sands, and heavy crudes.

35. The process of claim 32 wherein the pressure in the in-situ formation is maintained at from about 200 psi to about 2000 psi.

36. The process of claim 32 wherein the temperature in the in-situ formation is maintained within a range of from about 500° F. to about 900° F.

37. The process of claim 32 wherein at least a portion of the liquid stream is a hydrocarbon-containing liquid having a boiling range of from about 300° F. to about 1200° F.

38. The process of claim 32 wherein at least a portion of the liquid stream is a hydrocarbonaceous liquid having the property of donating and accepting hydrogen, and having a boiling range of from about 650° F. to about 975° F.

39. The process of claim 32 wherein at least about 50 volume percent of said gas comprises hydrogen.

40. A process for the recovery of carbonaceous materials from an underground formation, comprising:

(a) fracturing a portion of an underground formation, comprising carbonaceous material selected from the group consisting of coal, oil shale, tar sands, and heavy crudes, (b) contacting the carbonaceous material in-situ in the fractured formation with (1) a preheated liquid solvent, wherein at least a portion of the liquid is a hydrocarbon-containing liquid having a boiling range of from about 300° F. to about 1200° F., and further wherein at least a portion of the liquid is a hydrocarbonaceous liquid having the property of donating and accepting hydrogen, and having a boiling range of from about 650° F. to about 975° F., and (2) a preheated gas comprising at least 50 volume percent hydrogen, and wherein the pressure in the fractured formation is maintained at from about 200 psi to about 2000 psi, and the temperature is maintained at from about 500° F. to about 900° F., to produce a product mixture of at least a partially hydrogenated carbonaceous material and dissolved carbonaceous material, and (c) removing said product mixture from said formation.

41. The process of claim 40 comprising, in addition, removing a portion of said fractured formation prior to contacting said carbonaceous material in-situ in said fractured formation with said preheated liquid solvent and said preheated gas comprising hydrogen.

* * * * *